United States Patent [19]

Schenck

[11] 4,379,190

[45] Apr. 5, 1983

[54] FILLED THERMOPLASTIC COMPOSITIONS BASED ON MIXTURES OF ETHYLENE INTERPOLYMERS

[75] Inventor: Timothy T. Schenck, Wilmington, Del.

[73] Assignee: E. I. Du Pont de Nemours and Company, Wilmington, Del.

[21] Appl. No.: 273,420

[22] Filed: Jun. 15, 1981

Related U.S. Application Data

[63] Continuation-in-part of Ser. No. 251,989, Apr. 6, 1981, abandoned, which is a continuation-in-part of Ser. No. 176,782, Aug. 11, 1980, abandoned.

[51] Int. Cl.[3] ..... B32B 27/30; C08K 5/01; C08K 5/10; C08K 5/11

[52] U.S. Cl. ..... 428/95; 524/13; 524/14; 524/52; 524/287; 524/290; 524/291; 524/306; 524/308; 524/310; 524/311; 524/423; 524/424; 524/425; 524/437; 524/442; 524/445; 524/456; 524/474; 524/477; 524/508; 524/513; 524/524; 428/96; 428/97; 525/222; 525/228

[58] Field of Search ..... 260/42.52, 33.6 UA, 260/33.6 PQ, 31.4 R, 31.8 M, 29.6 RW; 428/95-97, 327; 524/13, 14, 52, 287, 290, 291, 306, 308, 310, 311, 423, 424, 425, 431, 442, 445, 456, 474, 477, 508, 513, 524; 575/222, 228

[56] References Cited

U.S. PATENT DOCUMENTS

| | | | |
|---|---|---|---|
| 3,010,899 | 11/1961 | Boyer | 252/29 |
| 3,203,921 | 8/1965 | Rosenfelder | 260/33.6 |
| 3,379,193 | 4/1968 | Monaghan | 128/136 |
| 3,497,375 | 2/1970 | Rundle | 117/5.1 |
| 3,904,456 | 9/1975 | Schwartz | 156/71 |
| 4,076,678 | 2/1978 | Lamb et al. | 260/31.8 R |
| 4,085,082 | 4/1978 | Lamb et al. | 260/31.6 |
| 4,085,083 | 4/1978 | Lamb et al. | 260/31.6 |
| 4,111,888 | 9/1978 | Lamb et al. | 260/31.6 |
| 4,191,798 | 3/1980 | Schumacher et al. | 428/95 |
| 4,242,395 | 12/1980 | Zuckerman et al. | 428/96 |
| 4,243,568 | 1/1981 | Brown | 260/42.52 |
| 4,263,196 | 4/1981 | Schumacher et al. | 260/42.52 |
| 4,266,542 | 5/1981 | Becker et al. | 525/222 |
| 4,335,034 | 6/1982 | Zuckerman et al. | 525/222 |

FOREIGN PATENT DOCUMENTS

| | | |
|---|---|---|
| 2319431 | 10/1973 | Fed. Rep. of Germany . |
| 940713 | 10/1963 | United Kingdom . |
| 2011803 | 7/1979 | United Kingdom . |
| 2016500 A | 9/1979 | United Kingdom . |

*Primary Examiner*—John C. Bleutge
*Assistant Examiner*—Herbert J. Lilling

[57] ABSTRACT

Filled thermoplastic compositions useful as sound deadening sheeting having improved tensile elongation are obtained by blending about 5-60 percent by weight of a mixture of at least two copolymers of ethylene, having specified polar comonomer contents, about 40-90 percent by weight of filler, 0-15 percent by weight of plasticizer selected from the group consisting of processing oils, polyesters, polyethers and polyether esters, and optionally modifying resins such as elastomeric polymers and certain other ethylene and propylene homo- and copolymers.

28 Claims, No Drawings

FILLED THERMOPLASTIC COMPOSITIONS BASED ON MIXTURES OF ETHYLENE INTERPOLYMERS

This application is a continuation-in-part of my copending application Ser. No. 251,989 filed Apr. 6, 1981, now abandon which application is a continuation-in-part of Ser. No. 176,782 filed Aug. 11, 1980, now abandon.

BACKGROUND OF THE INVENTION

1. Field of the Invention

This invention relates to filled compositions and, more specifically, it relates to filled compositions containing a mixture of at least two ethylene interpolymers.

2. Description of the Prior Art

The use of processing oils and other plasticizers with natural rubber or synthetic rubberlike compounds containing sulfur, accelerators, carbon black, and other additives customarily used in the rubber industry is well known. In some instances in order to obtain very high tensile strength values, fillers are omitted. On the other hand, it is known that styrene/butadiene rubber (SBR) compounds, such as are used to adhere jute secondary backings to carpets, can readily hold up to 80 percent by weight or more of calcium carbonate filler. Vulcanization or curing enhances blend strength.

For thermoplastic elastomeric uses, it is desirable both to avoid curing and to employ fillers to reduce blend costs, as well as to increase blend density.

Binary blends of ethylene/vinyl acetate (EVA) copolymer with filler are known as articles of commerce. The practical limit for addition of a filler such as the more commonly employed medium-density fillers, e.g., $CaCO_3$, bauxite, gypsum, etc., is about 75 percent by weight, even when using a relatively low melt index (higher molecular weight) resin, or softer, higher vinyl acetate grades. As filler levels rise, other properties suffer, such as melt index (as it drops, extruder pressures mount rapidly), softness (the "hand" becomes much stiffer), and elongation (which drops alarmingly). Ultimately, at about the 80 percent filler level, it is not possible to compound binary EVA/$CaCO_3$ blends as the mixture will no longer "flux" in a Banbury Mixer (the charge merely stirs—the resin will not "work" as the blades turn, no power rise ensues, the mixture on discharge is still discrete EVA pellets in a powdery Whiting mass). If one were to use a very dense filler, such as $BaSO_4$, approximately 10 percent by weight more filler can be added to binary EVA blends.

Industrial noise and its control are items of increasing concern to governmental, environmental, and industrial organizations. Governmental agencies are establishing noise limits to which workers may be exposed to protect their health.

From an aesthetic standpoint, noise also presents problems. Advertisements for "quiet riding" automobiles are ubiquitous. Manufacturers are attempting to make other vehicles quiet as well—including campers, trailers, buses, trucks, and off-road-use farm vehicles.

It has long been known that interposing mass between a sound source and the area to be kept quiet is an effective means for attaining sound deadening. A stone wall is extremely effective—but is not often practical. A sheet of lead is thin, flexible, often highly effective, but costly.

Sheets of thermoplastics or of rubberlike materials have long been used as sound-deadening means. To make the sheets flexible, dense, strong, and inexpensive has posed a challenge to compounders for many years. For some uses, such as automobile carpet underlayment, the sound-deadening sheet must also be moldable.

Schwartz U.S. Pat. No. 3,904,456 is related to a method for inhibiting transmission of airborne noise by interposing in the air space between the noise source and the location to be insulated a thin, dense, normally self-supporting film or sheet composed essentially of from about 10 to about 40 percent by weight of ethylene/vinyl acetate copolymer having an average vinyl acetate content of from about 10 to about 42 percent by weight and a glass transition temperature of at least about 30° C. below the average ambient temperature in the air space, and from about 60 to about 90 percent by weight of inorganic filler materials, such as sulfates, carbonates, oxides, etc. of barium, calcium, cadmium, etc., effective to produce an overall density greater than at least 2 grams per cubic centimeter.

EVA copolymers have been used industrially for nearly two decades; however, until recently they have not been known to be used in conjunction with processing oils as articles of commerce. This could well be an outgrowth of the way EVA commercialization has proceeded. That is, most EVA blends are based on EVA/paraffin wax technology, where paraffin wax weight is often up to ten times the weight of the EVA present. Furthermore, despite the obvious savings inherent in using lower-cost, lower-quality waxes, such as scale wax or slack wax, all attempts to do this have failed. The reason was always the same—the oil content of the wax migrated and destroyed the effectiveness of the coating or adhesive when the oil reached the bond or sheet surface. Thus, compounders "knew" that oil could not be used in EVA blends and technology developed along other lines.

Rundle U.S. Pat. No. 3,497,375 discloses coating compositions for wooden concrete molds consisting of ethylene/vinyl acetate copolymer and paraffinic oil. There is no filler employed in the coating compositions of this patent.

Monaghan U.S. Pat. No. 3,379,193 discloses teeth covers made of ethylene/vinyl acetate copolymer in itself or in combination with mineral oil and, if desired, with fibers and coloring materials. The preferred formulation is disclosed to be 47 percent by weight of ethylene/vinyl acetate copolymer, 47 percent by weight of mineral oil, 5 percent by weight of nylon fibers, and 1 percent by weight of titanium dioxide.

German Patent Application No. 2,319,431 discloses sound-deadening composites suitable for use in automobiles which consist of a highly filled polymer sheet (for example, 300–1200 or even up to 1500 parts of filler per 100 parts of polymer) which on its back side is provided with a filler material sheet, e.g., a polymer foam. Suitable polymers for use are disclosed to be terpolymers of ethylene, propylene, and a non-conjugated diene (EPDM), polyvinyl chloride (PVC), mixed polymers of ethylene and vinyl acetate (EVA), styrenebutadiene mixed polymers (SBR) and mixtures of these materials with thermoplastic polymers, such as polystyrene and polyolefins.

Boyer U.S. Pat. No. 3,010,899 discloses blends of ethylene/vinyl acetate resin and mineral oil which are either rubbery or greaselike, depending upon the proportion of oil to resin, and can be used as a substitute for crepe rubber or as a grease. It is further disclosed that fillers such as carbon black or finely divided clays can be added to the rubbery products to increase hardness and produce materials suitable as floor tile. As indicated for example in claim 11, the filler, carbon black, is present in a "minor amount" while the oil-ethylene/vinyl acetate copolymer mixture is present in a "Major amount".

Rosenfelder U.S. Pat. No. 3,203,921 discloses the use of compositions consisting essentially of 73–88 percent by weight of a homo- or copolymer of ethylene (which can be ethylene/vinyl acetate or ethylene/ethyl acrylate copolymer), 2–7 percent by weight of an aliphatic paraffinic hydrocarbon mineral oil and 10–20 percent by weight of a mineral filler (for example, calcium carbonate, barium sulfate, etc.) for preparing blow-molded objects such as dolls.

Schumacher and Yllo U.S. Pat. No. 4,191,798 discloses compositions consisting essentially of 5–50 percent by weight of ethylene interpolymer (e.g., ethylene/vinyl acetate copolymer), mixtures of two or more ethylene interpolymers being also disclosed as suitable, 2–15 percent by weight of processing oil, and 50–90 percent by weight of filler. These compositions are useful in the form of sound-deadening sheets and particularly as a back-side coating on automotive carpets.

British Patent GB No. 2,016,500A describes compositions comprising 100 parts by weight of powdered ethylene copolymer (e.g. ethylene/vinyl acetate), 40–220 parts by weight of a compatible liquid hydrocarbon oil, and optionally 100–600 parts by weight of filler. The hydrocarbon oil is disclosed to act as a plasticizer imparting flexibility and extensibility to the copolymer.

British Pat. No. 940,713, discloses the use of polyethers and polyether esters with ethylene/vinyl acetate copolymers primarily for, but not limited to, vulcanized compounds. The polyethers described are homopolymers of ethylene oxide, propylene oxide, or butylene oxide. The use of fillers is disclosed, silicic acid and carbon black being mentioned in particular. Although specific concentrations are not discussed, it is stated that fillers can be used in very large amounts. The highest filler concentration disclosed in the examples of this patent was 30 parts filler per 100 parts ethylene copolymer in a crosslinked composition containing other ingredients as well (i.e., about 22–23% filler based upon the weight of the filled composition).

U.S. Pat. No. 4,242,395, discloses thermoplastic compositions which are useful as backings for automotive carpets. These compositions comprise at least 60 percent by weight of inert mineral filler, 5 to 25 percent by weight of an ethylene homopolymer or copolymer (e.g. ethylene/vinyl acetate, ethylene/ethyl acrylate), 1 to 10 percent by weight of a nonvulcanized elastomeric resin, and 1 to 15 percent by weight of a plasticizer. The plasticizers disclosed include oils employed in rubber compounds and platicizers commonly used with polyvinyl chloride. Of the latter type phthalates, terephthalates and epoxidized oils were mentioned specifically. The relatively low molecular weight, liquid plasticizers were indicated to be preferred. Apparently the preferred hydrocarbon oils and polyvinyl chloride plasticizers give equivalent property performance. No specific mention is made of polyesters, or of polyethers, or their mixtures with hydrocarbon oils, as plasticizers. It is disclosed that part or all of the ethylene copolymer can be replaced with polyethylene.

SUMMARY OF THE INVENTION

According to the present invention, there is provided a composition consisting essentially of (a) from about 5 percent to about 60 percent by weight of a mixture of at least two copolymers of ethylene, copolymer (A) and copolymer (B), each copolymer having at least one polar comonomer selected from the group consisting of vinyl esters of saturated carboxylic acids wherein the acid moiety has up to 4 carbon atoms, unsaturated mono- or dicarboxylic acids of 3 to 5 carbon atoms, the salts of said unsaturated acids, and esters of said unsaturated acids wherein the alcohol moiety has 1 to 8 carbon atoms, copolymer (A) having a polar comonomer content of from about 2 to about 30 percent by weight, an ethylene content of from about 70 to about 98 percent by weight and a melt index of from about 0.1 to about 20, and copolymer (B) having a polar comonomer content of from about 28 to about 70 percent by weight, an ethylene content of from about 30 to about 72 percent by weight and a melt index of from about 5 to about 1000, provided that the polar comonomer content of copolymer (B) is at least 12 percent by weight higher than the polar comonomer content of copolymer (A) and the ratio of copolymer (A) to copolymer (B) is from about 99/1 to about 55/45; (b) from about 40 percent by about 90 percent by weight of filler; and (c) from 0 percent to about 15 percent by weight of at least one platicizer selected from the group consisting of processing oils, polyesters, polyethers, and polyether esters, provided that, when the filler level is above about 75 percent by weight, there is at about 1 percent by weight of plasticizer present, provided that when the filler level is at least 70 percent by weight said composition exhibits a tensile elongation at least 50% higher than a blend containing a single copolymer of ethylene having the same polar comonomer content and melt index as the mixture of at least two copolymers of ethylene has; (d) from 0 to about 27% by weight of elastomeric polymer; and (e) from 0 to about 48% by weight of olefin polymer selected from the group consisting of low density branched polyethylene, high density linear polyethylene, linear copolymers of ethylene and another olefin comonomer, polypropylene and copolymers of propylene and ethylene where the ethylene content is up to 20% by weight.

Further provided according to the present invention are the above compositions in the form of a sound-deadening sheet.

Still further provided according to the present invention are carpets and especially automotive carpets having a back-side coating consisting essentially of the above compositions.

As used herein the term "consisting essentially of" means that the named ingredients are essential; however, other ingredients which do not prevent the advantages of the present invention from being realized can also be included.

DETAILED DESCRIPTION OF THE INVENTION

U.S. Pat. No. 4,191,798 disclosed the use of a processing oil plasticizer to obtain highly loaded blends of ethylene/vinyl acetate (EVA) resin and filler. While U.S. Pat. No. 4,191,798 disclosed that a mixture of two or more ethylene copolymers can be used in place of a single copolymer, it has now been discovered that, by combining at least two different properly selected EVA copolymer grades, copolymers (A) and (B), with filler and plasticizer, unexpected and unusual modification of the physical properties of the filled composition can be achieved as compared with compositions containing only a single EVA resin grade. Most significantly, by replacing a single EVA grade in a filled blend with an equal amount of a properly selected mixture of two EVA grades, where the mixture has the same weight percent vinyl acetate content and melt index as the single EVA grade replaced, the tensile elongation can be increased manyfold.

The ethylene copolymers suitable for the composition of the present invention are copolymers with at least one polar comonomer selected from the group consisting of vinyl esters of saturated carboxylic acids wherein the acid moiety has up to 4 carbon atoms, unsaturated mono- or dicarboxylic acids of 3 to 5 carbon atoms, the salts of said unsaturated acids, and esters of said unsaturated acids wherein the alcohol moiety has 1 to 8 carbon atoms. Terpolymers of ethylene and the above polar comonomers are also suitable. Ionomers which are the completely or partially neutralized copolymers of ethylene and the acids described above are discussed in more detail in U.S. Pat. No. 3,264,272.

The polar comonomer (such as vinyl acetate) content of the first copolymer, copolymer (A), is from about 2 to about 30 percent by weight. The polar comonomer content of the second copolymer, copolymer (B), is from about 28 to about 70 percent by weight, provided that the polar comonomer content of the second copolymer is at least 12 weight percent greater than the polar comonomer content of the first copolymer. The balance of copolymers (A) and (B) is made up by ethylene.

The polar comonomer content of the first copolymer is preferably from about 5 to about 28 percent by weight, and the polar comonomer content of the second copolymer is preferably from about 30 to about 65 percent by weight, provided that the polar comonomer content of the second copolymer is at least 15 weight percent greater than the polar comonomer content of the first copolymer.

The most preferred polar comonomer content of the first copolymer is from about 10 to about 25 percent by weight, and the most preferred polar comonomer content of the second copolymer is from about 33 to about 60 percent by weight, provided that the polar comonomer content of the second copolymer is at least 18 percent greater than the polar comonomer content of the first copolymer.

The weight ratio of the first copolymer to the second copolymer in the compositions of the present invention can range from about 99/1 to about 55/45, preferably from about 97/3 to about 60/40, and most preferably from about 95/5 to about 65/35.

In accordance with the above, suitable ethylene copolymers are such as ethylene/vinyl acetate, ethylene/acrylic acid and its ionomers, ethylene/methacrylic acid and its ionomers, ethylene/methyl acrylate, ethylene/ethyl acrylate, ethylene/isobutyl acrylate, ethylene/normal butyl acrylate, ethylene/isobutyl acrylate/methacrylic acid and its ionomers, ethylene/normal butyl acrylate/methacrylic acid and its ionomers, ethylene/isobutyl acrylate/acrylic acid and its ionomers, ethylene/normal butyl acrylate/acrylic acid and its ionomers, ethylene/methyl methacrylate, ethylene/vinyl acetate/methacrylic acid and its ionomers, ethylene/vinyl acetate/acrylic acid and its ionomers, ethylene/vinyl acetate/monoethyl maleate and ethylene/methyl acrylate/monoethyl maleate. Particularly, suitable copolymers are ethylene/vinyl acetate, ethylene/ethyl acrylate, ethylene/methacrylate, ethylene/isobutyl acrylate and ethylene/methylmethacrylate copolymers.

The melt index of the first copolymer can range from about 0.1 to about 20, preferably from about 0.3 to about 10, and most preferably from about 0.5 to about 2. The melt index of the second copolymer can range from about 5 to about 1000, preferably from about 10 to about 200, and most preferably from about 15 to about 100.

Generally, from about 5 to about 60 percent by weight of the mixture of the first copolymer and the second copolymer is employed in the composition of the present invention. Preferably from about 8 to about 30 percent by weight, and most preferably from about 11 to about 25 percent by weight is employed.

In accordance with the above, when both the first copolymer and the second copolymer are selected from their respective most preferred ranges of polar comonomer content and melt index, and when they are used in a ratio of greater than 55/45, the resulting filled compositions exhibit properties well suited for use as a sound deadening sheet or for use as a back-side coating on automotive carpet.

If the first copolymer contains above about 25 percent by weight of polar comonomer and the second copolymer contains above about 60 percent by weight of polar comonomer, and the two copolymers are combined in a weight ratio approaching 55/45, the resulting filled composition will be extremely soft and tacky and can be used as a caulk or sealant.

At the other extreme, if the first copolymer has a polar comonomer content below about 10 percent and the second copolymer has a polar comonomer content below about 30 percent and the two copolymers are combined in a weight ratio approaching 99/1, the resulting filled composition will be relatively stiff, will exhibit no tackiness and can be used as a molded part. However, since the polar comonomer content is reduced to a minimum at this extreme, plasticizer compatibility problems may arise. Even compositions made with nonbleeding plasticizers become "oily" as polyethylene homopolymer is approached.

Tensile properties of the filled composition decline to lower levels when the melt index of the first polymer is above about 10 and the melt index of the second copolymer is above about 200. Lower melt index ranges, from about 0.5 to about 2 for the first copolymer and from about 15 to about 100 for the second copolymer, are preferred to maintain strength.

It is characteristic of the compositions of the present invention that, with the filler level and plasticizer level held constant, the tensile elongation will pass through a maximum value as the weight ratio of the two copolymers is varied. This maximum elongation typically will occur when the ratio of the first copolymer to the second copolymer is between about 85/15 and about 65/35; the specific ratio at which the maximum elongation will occur depends upon the particular pair of copolymers selected.

A principal advantage of the present invention is that, by use of a mixture of two properly selected copolymers in an optimum ratio as a replacement for a single copolymer with the same melt index and comonomer content as that of the mixture, the tensile elongation of the filled composition can be increased manyfold.

If the difference in polar comonomer content between the first copolymer and second copolymer is less than about 12 weight percent, no appreciable improvement in blend elongation is achieved by use of a mixture of copolymers. However, when the filler level is at least 70 weight percent and the difference in polar comonomer content between copolymer (A) and copolymer (B) is from about 12 to about 15 weight percent, blend elongation (as compared with an analogous blend based on a single copolymer) can be increased 50% or more. If the difference in polar comonomer content between copolymer (A) and copolymer (B) is from about 15 to about 18 weight percent, blend elongation (as compared with an analogous blend based on a single copolymer) can be increased 100% or more, and if the difference in polar comonomer content between copolymer (A) and copolymer (B) is greater than about 18 weight percent, blend elongation (as compared with an analogous blend based on a single copolymer) can be increased 150% or more.

The second essential ingredient of the composition of the present invention is the filler. The percentage of filler that can be included in the composition of the present invention on a weight basis is primarily a function of the density of the filler. Particle size of the filler has some effect. As filler particle size is varied, the ratio of copolymer (A) to copolymer (B) at which maximum blend elongation will occur also varies. In general, as particle size increases, the ratio of copolymer (A) to copolymer (B) that produces maximum blend elongation will also increase. Fine particle size fillers generally have a tendency to result in higher blend viscosities, and they are also more expensive. The use of fine filler, especially at high filler loading, results in a smoother extrudate surface when molten blend is extruded through a die orifice. The attendant benefits of using fine particle size filler in filled polymer blends are described in patent application Ser. No. 052,927, filed June 27, 1979, issued on Apr. 21, 1981 as U.S. Pat. No. 4,263,196, the disclosure of which is hereby incorporated by reference. No. 9 "Whiting" (Calcium carbonate) which has been used extensively in the present compositions (about 95 percent through 325 mesh) represents a viable midpoint in coarseness, availability, and cost.

The amount of filler present in the composition of the present invention is from about 40 percent to about 90 percent by weight, preferably from about 50 percent to about 85 percent by weight. Most preferably, when using a filler of medium density, such as calcium carbonate, the amount of filler is from about 65 to about 80 percent by weight, and when using a filler of higher density, such as barium sulfate, the amount of filler is from about 70 to about 85 percent by weight.

Examples of suitable fillers are calcium carbonate, barium sulfate, hydrated alumina, clay, magnesium carbonate, calcium sulfate, silica, flyash, cement dust, wood flour, ground rice hulls and mixtures thereof.

Most preferred fillers are calcium carbonate barium sulfate, hydrated alumina and mixtures thereof.

Hydrated alumina used as the filler will result in blends that are flame retardant.

The plasticizer ingredient of the present invention can be selected from one of several groups. The first group is the group known as processing oils. Three types of processing oils are known—paraffinic, aromatic, and naphthenic. None of these are pure; the grades identify the major oil type present. Paraffinic oils tend to "bleed" from blends. Bleeding is normally not desirable, but could be useful as specialty applications, for example, in concrete forms where mold release characteristics are valued.

Naphthenic and aromatic oils are nonbleeding when used in proper ratios and are thus preferable for uses such as automotive carpet backing.

Processing oils are also subdivided by viscosity range. "Thin" oils can be as low as 100–500 SUS (Saybolt Universal Seconds) at 100° F. (38° C.). "Heavy" oils can be as high as 6000 SUS at 100° F. (38° C.). Processing oils, especially naphthenic and paraffinic oils with viscosity of from about 100 to 600 SUS at 100° F. (38° C.) are preferred.

The second group of plasticizers that are effective in the composition of the present invention is the group comprising polyesters which are in general, liquid condensation products of a polybasic acid and a polyol. The term "liquid" in the context of the present invention is used to mean pourable at room temperature. The acid component is most often a saturated aliphatic dibasic acid or an aromatic dibasic acid; adipic acid, azelaic acid, phthalic acid, sebacic acid, and glutaric acid, or mixtures of these acids are commonly used. The polyol can be an aliphatic polyol or a polyoxyalkylene polyol, such as ethylene glycol, propylene glycol, 1,4- and 1,3-butane glycol, diethylene glycol, and polyethylene glycol. Preferred polyester compositions would consist of an acid component of which greater than 50 percent by weight are aliphatic dibasic acids, and a polyol component of aliphatic polyol or even more preferably aliphatic glycol. Most preferred compositions are based on adipic or azelaic acid, and propylene glycol or the 1,3- or 1,4-butane glycol. The molecular weight of these plasticizers can vary from a low of a few hundred up to a high of about 10,000. The molecular weight of commercial products is seldom specified; however, typically in the trade, the molecular weight range of the product is classified as low, medium, or high. The preferred range for purposes of the present compositions is that classified as medium.

Another group of plasticizers, polyethers, and polyether esters, are also effective plasticizers in the present compositions. In general, polyethers are oligomers or polymers of alkylene oxides; polymers of ethylene or propylene oxide are the most common types available commercially. Polyethers can be prepared by polymerization of aldehydes using various types of catalysts, or by acid or base catalyzed polymerization of an alkylene oxide, for example. Polyethers can be terminated by hydroxyl groups to form the diol (glycol) or, in the case of adducts of alkylene oxides with glycerol, for example, the triol, and so forth. The hydroxyl terminated polyether can also be reacted with an acid, fatty acids such as lauric and stearic acids are commonly used, to form the ester; the most common examples of these compounds are the mono- and diesters of polyethylene or polypropylene glycol. The molecular weight of polyethers may range up to those typical of high polymers.

Preferred polyether compositions in the practice of this invention are those consisting of the polyols based on random and/or block copolymers of ethylene oxides and propylene oxides. The copolymer polyols provide better performance in terms of efficiency in compounds of the present invention containing very high levels of filler.

These polyester, polyether and polyether ester plasticizers and their use in filled ethylene/polar comonomer interpolymers are the subject matter of simultaneously filed patent application Ser. No. 176,781 (attorney docket No. AD-5050) the disclosure of which application is hereby incorporated by reference.

A mixture of processing oil, on the one hand, and polyester or polyether or polyether ester, or any combination thereof, on the other hand, can also be used very effectively as the plasticizer for the compositions of the present invention. In fact, such a two or more component plasticizer system, comprising from about 50 to about 95 percent by weight of processing oil, gives higher tensile elongation than can be obtained using either plasticizer alone at the same level. Maximum elongation is achieved using a mixture of processing oil and polyester or polyether or polyether ester or any combination thereof comprising from about 50 to about 80 percent by weight of processing oil.

From 0 to about 15 percent by weight of plasticizer (or plasticizer mixture) can be used in the compositions of the present invention provided that, when the filler level is above about 75 percent by weight, at least about 1 percent by weight of plasticizer is used. As filler level is increased above about 75 percent by weight, some plasticizer is desired to "flux" the blend in conventional high-intensity mixing equipment. As the plasticizer level is increased above about 10 percent by weight, the melt index will increase rapidly and the composition will become much softer. In general, as the polar comonomer content of the second copolymer approaches 65 percent, the melt index of the second copolymer approaches 1000, and the ratio of the first copolymer to the second copolymer approaches 55/45, less plasticizer is required to "flux" the composition in conventional equipment; the second copolymer itself acts as a plasticizer for the blend.

Preferably, the total amount of plasticizer is from about 3 to about 10 percent by weight and most preferably it is from about 4 to about 8% by weight.

The use of at least two copolymers, copolymer (A) and copolymer (B), as described above is essential to the present invention; one or more additional copolymer of the same type as copolymer (A) and/or copolymer (B) can also be included to obtain some desired property modification.

Polymers, both homo- and copolymers, other than the ones referred to above, can also be used to some extent in combination with the above specified copolymer pairs without significantly interfering with the advantages obtained by the present invention.

Similarly, other ingredients can also be added to the compositions of the present invention by a compounder in order to obtain some desired effect, such as reduction of cost, or enhancement of physical properties. Accordingly, extender or modifying resins, tackifying resins, waxes, other slip agents, foaming agents, crosslinked agents, antioxidants, flame retardant agents, etc. that are widely used, can be included in the compositions of the present invention.

Elastomeric polymers are of interest as modifying resins for the blends of the present invention. They exhibit good compatibility in the blends and can be useful for modifying flexibility or other physical properties. The blends of the present invention can contain from 0 to about 27%, by weight of an elastomer or a mixture of elastomers, preferably from about 1 to about 17% by weight, and most preferably from about 2 to about 12% by weight. Mooney viscosity of the elastomers is preferably in the range of from 20 to 90. Thermoplastic elastomers (e.g., ethylene-propylene rubber, styrene-butadiene-styrene, polyurethane, etc.) or vulcanizable elastomers (e.g., styrene-butadiene rubber, ethylene/propylene/diene terpolymer (EPDM), chlorosulfonated polyethylene, etc.) can be used. Preferred elastomers are ethylene-propylene rubber and EPDM rubber in which the ethylene content should range from above 20 percent by weight to about 80 percent by weight. The diene comonomer (in EPDM) is usually methylene norbornene, ethylidene norbornene, dicyclopentadiene or 1,4-hexadiene, although other dienes may be used, and the concentration of the diene is usually less than about 5 percent by weight. When vulcanizable elastomers are used, they are added in the nonvulcanized state; if desired, the resulting compound can be cured in a subsequent operation to produce a product with increased tensile strength and improved high temperature performance.

Another class of modifying resins useful in the practice of this invention are the low density branched homopolymers of ethylene, the high density linear homopolymers of ethylene, the linear copolymers of ethylene and another olefin monomer, homopolymers of propylene, and copolymers of propylene and ethylene where the ethylene content is up to 20% by weight. For reasons of compatibility and the balance of properties obtained, the preferred materials are the high density ethylene homopolymers, the linear copolymers of ethylene and another olefin, and the copolymers of propylene and ethylene. The olefin content and the olefins used in the linear copolymers are described in U.S. Pat. No. 4,076,698. The propylene/ethylene copolymers may contain up to 20% by weight ethylene. When used in combination with the ethylene copolymers described previously in compounds of the present invention, materials with an unusual range of properties result. These properties include the high density useful in sound deadening applications, low cost due to the high filler content, good toughness due to the presence of the ethylene copolymers and to the use of the polyester and the polyether plasticizers of this invention, very high stiffness due to the modifying resins, and good adhesion due to the presence of the ethylene copolymer(s) described previously. The members of this class of modifying resins can be present in the blend in an amount of from 0 to about 48% by weight, preferably from about 1 to about 22% by weight, and most preferably from about 2 to about 15% by weight.

The blends of the present invention are thermoplastic in nature and therefore can be recycled after processing. The recycled material may also contain textile fibers, jute, etc. present in the trim obtained during production of the finished product (e.g., back-coated automotive carpet).

A commercially sized batch-type Banbury or equivalent intensive mixer is entirely suitable for preparing the compositions of the present invention. A Farrell continuous mixer ("FCM") is also an excellent mixing device. In either instance, dry ingredients are charged in routine fashion. It is convenient in most instances to inject the plasticizer component directly into the mixing chamber of either unit as per widely used practice with this type of equipment. When more than one plasticizer is used, and where any one of the plasticizers is present in a small amount (less than about 10 weight percent of the total plasticizer mixture), the plasticizers should be preblended before addition to the other ingredients of the present invention. This will facilitate uniform distribution of each plasticizer component in the final composition and thus ensure that optimum properties are obtained. If desired, both copolymers or either or both copolymers and the plasticizer(s) can be precompounded as a "Masterbatch" in a suitable intensive mixing device (e.g., Banbury mixer or screw extruder). This "Masterbatch" can then be compounded with the filler and the other remaining ingredients to produce the final composition. A mix cycle of about 3 minutes is generally adequate for the Banbury Mixer at an operating temperature usually between 325° and 375° F. The operating rate for the FCM unit generally will fall within ranges predicted by literature prepared by the Farrell Company, Ansonia, Connecticut. Again, temperatures between 325° and 375° F. are effective. In both cases, a very low plasticizer level, say about 0–3 percent, may require higher temperatures, while plasticizer levels above about 7 percent may mix well at lower mixer temperatures. While not evaluated, it is expected that other devices for compounding of viscous mixes should be entirely satisfactory—but in any case, prototype trials in advance are desirable.

Primary use for the compositions of the present invention will probably be in the sheeting field, particularly for low-cost, dense, sound-deadening structures. Outstanding characteristics such as improved "hand," "drape," and reduced stiffness of the extruded sheeting result from the compositions of the present invention.

The blends of the present invention are characterized by increased elongation at lower tensile strength as compared with analogous blends based on a single copolymer. In practice, higher elongation results in improved resistance to cracking or tearing of the material. In certain applications, such as backing for automotive carpet, resistance to cracking and tearing is considered a critical property requirement of the composition; tensile strength per se is generally not considered important. In this use, the blends of the present invention, because of their superior crack and tear resistance, offer a significant advantage over analogous blends based on a single copolymer.

The blends of the present invention can readily be extruded onto a substrate, such as an automotive carpet, or can be extruded or calendered as unsupported film or sheet. Depending upon the equipment used, and the compounding techniques employed, it is possible to extrude wide ranges of film thickness, from below 20 mils to above 100 mils. This then provides industry with an opportunity to vary the amount of sound deadening to be attained by varying film thickness, density of blends, ratio of filler load to binder, and similar techniques well known in the art.

The sound-deadening sheet produced may be used in various ways:

When applied to automotive carpet, blends described are an effective and economic means to deaden sound, while also simultaneously serving as a moldable support for the carpet.

When used in sheet form, the blends can be installed in other areas of an automobile, truck, bus, etc., such as side panels, door panels, roofing area, etc.

In sheet form, blends may be used as drapes or hangings to shield or to surround a noisy piece of factory equipment such as a loom, a forging press, etc.

In laminated sheet form, blends, faced with another material, might be used to achieve both a decorative and a functional use—such as dividing panels in an open-format office.

The application of the compositions of the present invention in carpets, and particularly in automotive carpets, is essentially identical to the methods as already described in U.S. Pat. No. 4,191,798, the disclosure of which is hereby incorporated by reference.

The following examples are given for the purpose of illustrating the present invention. All parts and percentages are by weight unless otherwise specified.

The samples in all examples were compounded in a laboratory-sized Banbury intensive mixer for a flux time of 3–5 minutes at a temperature of about 325°–400° F. All ingredients were premixed in a one-gallon can by being shaken manually for about 5 minutes before charging to the Banbury mixer.

EXAMPLES 1 and 2 and COMPARATIVE EXAMPLES 1 and 2

These examples illustrate how the tensile elongation of a blend can be increased by replacing a single EVA copolymer with a mixture of two EVA copolymers, where the mixture has the same nominal vinyl acetate content and nominal melt index as the single copolymer replaced. The melt index of the copolymer mixture is measured by melt-blending the mixture intensively, e.g., on a two-roll mill, and measuring the melt index of the resulting blend. Compositions and physical properties are summarized in Table 1.

The blend of Example C-1 contains 20.2 weight percent of an EVA copolymer having a vinyl acetate content of 18 weight percent and a melt index of 0.6–0.8. The tensile elongation of the blend is 21 percent. The blend of Example 1 contains 20.2 percent by weight of a mixture of two EVA copolymers as a total replacement for the single copolymer used in Example C-1, where the mixture has a vinyl acetate content of 18 percent and a melt index of 0.78. The tensile elongation of this blend is 369 percent, approximately 17 times the elongation of the single copolymer analog blend of Example C-1.

The blend of Example C-2 contains 20.2 weight percent of an EVA copolymer having a vinyl acetate content of 25 weight percent and a melt index of b 1.7–2.3. The tensile elongation of this blend is 44 percent. The blend of Example 2 contains 20.2 weight percent of a mixture of two EVA copolymers as a total replacement for the single copolymer used in Example C-2, where the mixture has a vinyl acetate content of 25 weight percent and a melt index of 2.6. The tensile elongation of this blend is 472 percent, approximately 10 times the elongation of the single copolymer analog blend of Example C-2.

It should be noted that in both cases (Ex. 1 vs. Ex. C-1 and Ex. 2 vs. Ex. C-2), while the use of a copolymer mixture increases elongation, tensile strength is reduced as compared with the single copolymer analog. However, when the compositions of the present invention are used as a back coat for automotive carpet, elongation is considered one of the most critical physical properties with tensile strength being of relatively minor importance. Furthermore, an indicative property in comparing the physical quality of filled compositions is the "toughness" which is approximately proportional to the product of elongation and tensile strength. The blend of Example 1 is about 7 times as "tough" as the blend of Example C-1; the blend of Example 2 is about 5 times as "tough" as the blend of Example C-2.

TABLE 1

COMPOSITION AND PHYSICAL PROPERTIES OF EVA - $CaCO_3$ - PROCESSING OIL BLENDS

| | Ex. C-1 | Ex. 1 | Ex. C-2 | Ex. 2 |
|---|---|---|---|---|
| Ingredients | | | | |
| EVA #1[1] | 20.2 | — | — | 13.8 |
| EVA #2[2] | — | 15.9 | — | — |
| EVA #3[3] | — | 4.3 | — | 6.4 |
| EVA #4[4] | — | — | 20.2 | — |
| #9 Whiting[5] | 72.5 | 72.5 | 72.5 | 72.5 |
| "Circorsol" 4240[6] | 7.3 | 7.3 | 7.3 | 7.3 |
| Physical Properties | | | | |
| Sp. Gr. of Blend[7] | 1.86 | 1.85 | 1.88 | 1.86 |
| Tensile Strength[8] | | | | |
| psi | 836 | 322 | 574 | 294 |
| kPa | 5,763 | 2,220 | 3,957 | 2,027 |
| Elongation, %[8] | 21 | 369 | 44 | 472 |
| Thickness of Strip | | | | |
| mils | 59 | 59 | 58 | 58 |
| mm | 1.50 | 1.50 | 1.47 | 1.47 |
| Stiffness of Strip, g.[9] | 98 | 46 | 61 | 36 |

[1]18 percent by weight vinyl acetate, 82 percent by weight ethylene; MI = 0.7.
[2]12 percent by weight vinyl acetate, 88 percent by weight ethylene; MI = 0.3.
[3]40 percent by weight vinyl acetate, 60 percent by weight ethylene; MI = 57.
[4]25 percent by weight vinyl acetate, 75 percent by weight ethylene; MI = 2.
[5]Calcium carbonate, as commercial ground limestone; Georgia Marble Company.
[6]A naphthenic processing oil avaliable from Sun Petroleum Products Company. The composition for the oil as given by the supplier is 39 percent naphthenic carbon, 40 percent paraffinic carbon, and 21 percent aromatic carbon. Viscosity at 100° F. is 2525 SUS. Specific gravity is 0.949.
[7]Referred to water.
[8]Tensile strength and elongation measurements made on Instron testing machine using ASTM method D 1708 at crosshead speed of 2 in. (5.1 cm.)/min. Samples are 0.876 in. (2.23 cm.) × 0.187 in. (0.47 cm.) in size at strip thickness shown in table.
[9]Stiffness of strip measured by placing a 1 in. × 6 in. (2.54 cm. × 15.2 cm.) strip on a platform scale and measuring the force required to make the ends of the test strip meet at room temperature.

EXAMPLES 3-9 and COMPARATIVE EXAMPLES 1 and 3

These examples illustrate how the tensile elongation of a filled blend passes through a maximum as the ratio of the first copolymer to the second copolymer is varied, with the filler and plasticizer constituents of the blend held constant. Compositions and physical properties are summarized in Table 2. For the particular copolymer pair selected in Examples 3-9, the maximum elongation occurs when the ratio of the first copolymer to the second copolymer is somewhere between 87/13 and 77/23. The specific ratio at which maximum blend elongation occurs can be determined experimentally by varying the ratio in smaller increments over this range.

Note that blends based on 100 percent of the first copolymer or the second copolymer alone (Ex. C-1 and Ex. C-3) exhibit lower elongation than the blends based on a mixture of these two copolymers.

TABLE 2

COMPOSITION AND PHYSICAL PROPERTIES OF EVA - $CaCO_3$ - PROCESSING OIL BLENDS

| | Ex. C-1 | Ex. 3 | Ex. 4 | Ex. 5 | Ex. 6 | Ex. 7 |
|---|---|---|---|---|---|---|
| Ingredients | | | | | | |
| EVA #1 | 20.2 | 18.4 | 17.5 | 16.5 | 15.6 | 14.7 |
| EVA #3 | — | 1.8 | 2.7 | 3.7 | 4.6 | 5.5 |
| #9 "Whiting" | 72.5 | 72.5 | 72.5 | 72.5 | 72.5 | 72.5 |
| "Circosol" 4240 | 7.3 | 7.3 | 7.3 | 7.3 | 7.3 | 7.3 |
| Ratio of First Polymer to Second Polymer (EVA #1/EVA #3) | ∞ | 91/9 | 87/13 | 82/18 | 77/23 | 73/27 |
| Sp. Gr. of Blend | 1.86 | 1.79 | 1.83 | 1.85 | 1.83 | 1.84 |
| Tensile Strength | | | | | | |
| psi | 836 | 410 | 399 | 386 | 344 | 328 |
| kPa | 5763 | 2827 | 2751 | 2661 | 2372 | 2261 |
| Elongation, % | 21 | 502 | 529 | 559 | 529 | 529 |
| Thickness of Strip | | | | | | |
| mils | 59 | 60 | 59 | 58 | 59 | 58 |
| mm | 1.50 | 1.52 | 1.50 | 1.47 | 1.50 | 1.47 |
| Stiffness of Strip, g. | 98 | 54 | 52 | 44 | 41 | 34 |

TABLE 2-continued

COMPOSITION AND PHYSICAL PROPERTIES OF EVA - $CaCO_3$ - PROCESSING OIL BLENDS

| | Ex. 8 | Ex. 9 | Ex. C-3 |
|---|---|---|---|
| Ingredients | | | |
| EVA #1 | 13.8 | 11.9 | — |
| EVA #3 | 6.4 | 8.3 | 20.2 |
| #9 "Whiting" | 72.5 | 72.5 | 72.5 |
| "Circosol" 4240 | 7.3 | 7.3 | 7.3 |
| Ratio of First Polymer to Second Polymer (EVA #1/EVA #3) | 68/32 | 60/40 | 0 |
| Sp. Gr. of Blend | 1.84 | 1.84 | 1.90 |
| Tensile Strength | | | |
| psi | 249 | 257 | 152 |
| kPa | 1717 | 1772 | — |
| Elongation, % | 468 | 350 | 95 |
| Thickness of Strip | | | |
| mils | 58 | 58 | 57 |
| mm | 1.47 | 1.47 | — |
| Stiffness of Strip, g. | 35 | 29 | 15 |

EXAMPLE 10 and COMPARATIVE EXAMPLE 4

A principal advantage of the present invention is that a significant improvement in the tensile elongation of filled blends can be obtained by replacing a single copolymer in the blend by a properly selected mixture of two copolymers. However, in applications where the physical properties can be reduced, it is probable that many users will increase the filler level in the blends, diminishing the physical properties to a level which is still adequate for the application, and thus reduce the raw materials cost to a minimum (by replacing the EVA copolymer at a cost of about 70¢/pound with filler at a cost of about 1¢/pound). This is particularly true for automotive carpet back coat and sound-deadening sheet, which depend upon mass to be effective and often do not require great blend elongation.

Comparative Example 4 (Table 3) is a blend based on a single copolymer containing 79 weight percent filler. It exhibits 11 percent elongation and fails in the crease test; performance that would generally be considered unacceptable for use as automotive carpet backing. Example 10 is a blend analogous to C-4 where the single copolymer has been replaced by a mixture of two copolymers having the same vinyl acetate content and nominal melt index. It exhibits 274 percent elongation and has no tendency to crack in the crease test; performance that generally would be considered attractive for use as automotive carpet backing. Also note that the blend of Example 10 with 79 percent filler exhibits about six times the elongation of the single copolymer analog at 72.5 percent filler (Ex. C-2).

These examples illustrate how the use of a mixture of copolymers can be effective in obtaining blends with higher filler loading (and reduced cost) and equal or higher elongation than can be achieved in blends based on a single copolymer.

TABLE 3

COMPOSITION AND PHYSICAL PROPERTIES OF BLENDS OF EVA - $CaCO_3$ - OIL

| | Ex. C-4 | Ex. 10 |
|---|---|---|
| Ingredients | | |
| EVA #1 | — | 8.9 |
| EVA #3 | — | 4.2 |
| EVA #4 | 13.1 | — |
| #9 "Whiting" | 79.0 | 79.0 |
| "Circosol" 4240 | 7.9 | 7.9 |
| Physical Properties | | |
| Sp. Gr. of Blend | 1.97 | 1.99 |
| Tensile Strength | | |
| psi | 597 | 208 |
| kPa | 4116 | 1434 |
| Elongation, % | 11 | 274 |
| Thickness of Strip | | |
| mils | 60 | 59 |
| mm | 1.52 | 1.50 |
| Stiffness of Strip, g. | 80 | 34 |
| Crease Resistance(1) | Fail | Pass |

(1)The crease resistance test is performed by folding a 1" × 6" (2.54 cm × 15.24 cm) strip at ambient temperature back upon itself and pinching or pressing the folded area flat. (This corresponds to folding the sample over a mandrel of zero diameter.) If a clean break occurs, with the strip splitting into separate pieces, the sample fails the test. If the sample exhibits surface cracking without splitting into separate pieces, it is rated pass minus. If the sample exhibits no surface cracks, it is rated pass, eventhough the sample may "stress-whiten" in the extended area.

EXAMPLES 11-13

Examples 11-13 illustrate the effect of using a polyester as the plasticizer in either total or partial replacement of the processing oil plasticizer. Results are summarized in Table 4.

The blend of Example 11 containing processing oil as the total plasticizer exhibits 472 percent elongation and a stiffness of 36 grams. The blend of Example 12 containing polyester as the total plasticizer exhibits 346 percent elongation and a stiffness of 15 grams. The blend of Example 13 illustrates the effect of replacing about ⅓ of the processing oil in the blend with the polyester; elongation is increased to 517 percent with a stiffness of 29 grams. This example demonstrates an interesting and unexpected effect: a blend containing a mixture of processing oil and polyester exhibits higher elongation than the blends containing either plasticizer alone.

It becomes apparent from these examples that the selection of the plasticizer (or combination of plasticizers) in the practice of the present invention offers the user significant latitude in obtaining physical properties appropriate for his particular end-use or application.

TABLE 4

COMPOSITION AND PHYSICAL PROPERTIES OF BLENDS CONTAINING EVA - $CaCO_3$ - OIL AND/OR POLYESTER

| | Ex. 11 | Ex. 12 | Ex. 13 |
|---|---|---|---|
| Ingredients | | | |
| EVA #1 | 13.8 | 13.8 | 13.8 |
| EVA #3 | 6.4 | 6.4 | 6.4 |
| #9 "Whiting" | 72.5 | 72.5 | 72.5 |
| "Circosol" 4240 | 7.3 | — | 4.9 |
| "Santicizer" 429(1) | — | 7.3 | 2.4 |
| Physical Properties | | | |
| Sp. Gr. of Blend | 1.86 | 1.82 | 1.86 |
| Tensile Strength | | | |
| psi | 294 | 211 | 266 |
| kPa | 2027 | 1455 | 1834 |
| Elongation, % | 472 | 346 | 517 |
| Thickness of Strip | | | |
| mils | 58 | 57 | 58 |
| mm | 1.47 | 1.45 | 1.47 |
| Stiffness of Strip, g. | 36 | 15 | 29 |

(1)Polyester plasticizer based on condensation product of aliphatic dibasic acid and aliphatic diol; avalilable from Monsanto Company;
Gravity = 1.080-1.110 @ 25° C.;
Viscosity = 40-60 stokes @ 25° C.

EXAMPLES 14 and COMPARATIVE EXAMPLE 5

Whiting ($CaCO_3$) is a very common and cheap filler with a density of about 2.7 g./cm.$^3$. One might elect to use a very dense, but more costly, filler to achieve a special purpose. Table 5 illustrates how the present invention can be practiced with barytes (density about 4.4 g./cm.$^3$) as the filler.

Comparative Example 5 is a blend based on 6.5 weight percent of a single EVA copolymer containing 88 weight percent barytes and 5.5 weight percent processing oil. It exhibits 27 percent elongation and rates pass minus in the crease test, with deep surface cracks developing in bending. The blend of Example 14 is analogous to C-5 where the single EVA copolymer has been replaced by a mixture of two EVA copolymers having the same vinyl acetate content and nominal melt index. It exhibits 124 percent elongation and passes the crease test with no surface cracks developing on bending.

TABLE 5

COMPOSITION AND PHYSICAL PROPERTIES OF EVA-BARYTES-PROCESSING OIL BLENDS

| | Ex. C-5 | Ex. 14 |
|---|---|---|
| Ingredients | | |
| EVA #1 | — | 4.44 |
| EVA #3 | — | 2.06 |
| EVA #4 | 6.5 | — |
| Barytes(1) | 88.0 | 88.0 |
| "Circosol" 4240 | 5.5 | 5.5 |
| Physical Properties | | |
| Sp. Gr. of Blend | 3.16 | 3.14 |
| Tensile Strength | | |
| psi | 374 | 163 |
| kPa | 2579 | 1124 |
| Elongation, % | 27 | 124 |
| Thickness of Strip | | |
| mils | 61 | 61 |
| mm | 1.55 | 1.55 |
| Stiffness of Strip, g. | 75 | 33 |
| Crease Resistance | Pass Minus | Pass |

(1)#22 barytes supplied by Thompson, Weinman Company, primarily $BaSO_4$, density about 4.4 g./cm.$^3$.

EXAMPLE 15 and COMPARATIVE EXAMPLE 6

This example illustrates how effective compounds can be prepared without the use of a plasticizer even at relatively high filler loading (Table 6). The blend of Example 15 contains 72.5 weight percent filler, no plasticizer, and 27.5 weight percent of a mixture of two EVA copolymers where the vinyl acetate content of the mixture is about 33 weight percent, and the nominal melt index of the mixture is 10. The blend was easily fluxed in the laboratory Banbury Mixer using a standard 3-minute cycle. Although this example shows that a plasticizer is not always required in the practice of the present invention to obtain uniformly compounded product in conventional mixing equipment, some plasticizer addition may still be desirable to obtain certain property modifications, e.g., lower stiffness or reduced melt viscosity.

The blend of comparative Example 6 is analogous to Example 15, containing 72.5 weight percent filler, no plasticizer, and 27.5 weight percent of a single EVA copolymer with a vinyl acetate content of about 33 weight percent and a melt index of 10. This blend was also easily fluxed in a standard 3-minute Banbury cycle. However, the blend of Example 15 exhibits 285 percent elongation, and the blend of Example C-6 exhibits 69 percent elongation—demonstrating that a principal advantage of the present invention, increased tensile elongation, is still apparent even with no plasticizer present in the blend.

TABLE 6

COMPOSITION AND PHYSICAL PROPERTIES OF BLENDS CONTAINING EVA AND FILLER

| | Ex. 15 | Ex. C-6 |
|---|---|---|
| Ingredients | | |
| EVA #5(1) | 16.8 | — |
| EVA #6(2) | 10.7 | — |
| EVA #7(3) | — | 27.5 |
| #9 "Whiting" | 72.5 | 72.5 |
| Physical Properties | | |
| Sp. Gr. of Blend | 1.86 | 1.86 |
| Tensile Strength | | |
| psi | 413 | 704 |
| kPa | 2847 | 4853 |
| Elongation, % | 285 | 69 |
| Thickness of Strip | | |
| mils | 59 | 59 |
| mm | 1.50 | 1.50 |
| Stiffness of Strip, g. | 56 | 74 |

(1)18 percent by weight vinyl acetate, 82 percent by weight ethylene; MI = 8.
(2)57 percent by weight vinyl acetate, 43 percent by weight ethylene; MI = 18.
(3)33 percent by weight vinyl acetate, 67 percent by weight ethylene; MI = 10.

EXAMPLES 16–20

These examples further illustrate how the tensile elongation of a filled blend passes through a maximum as the ratio of the first copolymer to the second copolymer is varied (see Table 7). For this particular copolymer pair, maximum elongation occurs at a ratio of about 80/20. Once again, the specific ratio at which maximum blend elongation occurs can be determined experimentally by varying the ratio in small increments around this value.

It is typical of the blends of the present invention that, although tensile elongation passes through a maximum as the ratio of the first copolymer to the second copolymer is varied from a high to low value, tensile strength and stiffness vary monotonously. (In these examples both properties decrease steadily). This provides additional latitude for the compounder to tailor the physical properties of the blend to a specific application. For example, by adjusting polymer ratio properly for a specific copolymer pair, with filler and plasticizer held constant one can prepare two blends having equal elongation and different stiffness.

TABLE 7

COMPOSITION AND PHYSICAL PROPERTIES OF EVA - $CaCO_3$ - PROCESSING OIL BLENDS

| | Ex. 16 | Ex. 17 | Ex. 18 | Ex. 19 | Ex. 20 |
|---|---|---|---|---|---|
| Ingredients | | | | | |
| EVA #1 | 18.2 | 17.5 | 16.8 | 16.2 | 15.6 |
| EVA #8(1) | 2.0 | 2.7 | 3.4 | 4.0 | 4.6 |

TABLE 7-continued

COMPOSITION AND PHYSICAL PROPERTIES OF EVA - $CaCO_3$ - PROCESSING OIL BLENDS

| | Ex. 16 | Ex. 17 | Ex. 18 | Ex. 19 | Ex. 20 |
|---|---|---|---|---|---|
| #9 "Whiting" | 72.5 | 72.5 | 72.5 | 72.5 | 72.5 |
| "Circosol" 4240 | 7.3 | 7.3 | 7.3 | 7.3 | 7.3 |
| Ratio of First Polymer to Second Polymer (EVA #1/ EVA #8) | 90/10 | 87/13 | 83/17 | 80/20 | 77/23 |
| Sp. Gr. of Blend | 1.86 | 1.84 | 1.82 | 1.83 | 1.81 |
| Tensile Strength | | | | | |
| psi | 560 | 553 | 464 | 442 | 403 |
| kPa | 3860 | 3812 | 3199 | 3047 | 2778 |
| Elongation, % | 189 | 236 | 397 | 430 | 274 |
| Thickness of Strip | | | | | |
| mils | 59 | 60 | 60 | 60 | 59 |
| mm | 1.50 | 1.52 | 1.52 | 1.52 | 1.50 |
| Stiffness of Strip, g | 84 | 80 | 69 | 65 | 51 |

(1)33 percent by weight vinyl acetate, 67 percent by weight ethylene; MI = 43

EXAMPLES 21–22 and COMPARATIVE EXAMPLE 7

These examples show that effective compounds can be prepared when part of the mixture of ethylene copolymers in a blend is replaced with an elastomeric polymer.

Comparative Example 7 is a blend based on 10.1 weight percent of a single EVA copolymer and 10.1 weight percent of an EPDM rubber. It exhibits a tensile elongation of 147 percent. The blend of Example 21 is analogous to C-7 where the single EVA copolymer has been replaced by a mixture of two EVA copolymers having the same vinyl acetate content and melt index. This blend exhibits a tensile elongation of 658 percent—greater than four times the elongation exhibited by the blend of Example C-7. This comparison demonstrates that a principal advantage of the present invention—i.e., increased tensile elongation in a filled blend by the use of a copolymer mixture—is attendant even when fifty percent of the polymer in the blend has been replaced by an elastomer.

TABLE 8

COMPOSITION AND PHYSICAL PROPERTIES OF BLENDS OF EVA - ELASTOMERIC POLYMER - $CaCO_3$ - PLASTICIZER

| | Ex. 21 | Ex. 22 | Ex. C-7 |
|---|---|---|---|
| Ingredients | | | |
| EVA #1 | 6.9 | 10.35 | — |
| EVA #3 | 3.2 | 4.8 | — |
| EVA #4 | — | — | 10.1 |
| #9 "Whiting" | 72.5 | 72.5 | 72.5 |
| "Circosol" 4240 | 7.3 | — | 7.3 |
| "Santicizer" 429 | — | 7.3 | — |
| EPDM Rubber(1) | 10.1 | 5.05 | 10.1 |
| Physical Properties | | | |
| Sp. Gr. of Blend | 1.80 | 1.80 | 1.79 |
| Tensile Strength | | | |
| psi | 367 | 239 | 369 |
| kPa | 2530 | 1647 | 2544 |
| Elongation, % | 658 | 468 | 147 |
| Thickness of Strip | | | |
| mils | 60 | 60 | 61 |
| mm | 1.52 | 1.52 | |
| Stiffness of Strip, g | 47 | 16 | 52 |

(1)"Nordel" 1560 Hydrocarbon Rubber; Du Pont Co. Sulfur curable polymer based on ethylene/propylene/1,4-hexadiene. Mooney viscosity, $ML_{(1+4)}$ @ 121° C., of 60.

I claim:

1. A composition consisting essentially of (a) from about 5 percent to about 60 percent by weight of a mixture of at least two copolymers of ethylene, copolymer (A) and copolymer (B), each copolymer having at least one polar comonomer selected from the group consisting of vinyl esters of saturated carboxylic acids wherein the acid moiety has up to 4 carbon atoms, unsaturated mono- or dicarboxylic acids of 3 to 5 carbon atoms, the salts of said unsaturated acids, and esters of said unsaturated acids wherein the alcohol moiety has 1 to 8 carbon atoms, copolymer (A) having a polar comonomer content of from about 2 to about 30 percent by weight, an ethylene content of from about 70 to about 98 percent by weight and a melt index of from about 0.1 to about 20, and copolymer (B) having a polar conomoner content of from about 28 to about 70 percent by weight, an ethylene content of from about 30 to about 72 percent by weight and a melt index of from about 5 to about 1000, provided that the polar comonomer content of copolymer (B) is at least 12 percent by weight higher than the polar comonomer content of copolymer (A) and the weight ratio of copolymer (A) to copolymer (B) is from about 99/1 to about 55/45;

(b) from about 40 percent to about 90 percent by weight of filler;

(c) from 0 percent to about 15 percent by weight of at least one plasticizer selected from the group consisting of processing oils, polyesters, polyethers and polyether esters provided that, when the filler level is above about 75 percent by weight, there is at least about 1 percent by weight of plasticizer present, provided that when the filler level is at least 70 percent by weight said composition exhibits a tensile elongation at least 50% higher than a blend containing a single copolymer of ethylene having the same polar comonomer content and melt index as the mixture of at least two copolymers of ethylene has;

(d) from 0 to about 27% by weight of elastomeric polymer; and (e) from 0 to about 48% by weight of olefin polymer selected from the group consisting of low density branched polyethylene, high density linear polyethylene, linear copolymers of ethylene and another olefin comonomer, polypropylene and copolymers of propylene and ethylene where the ethylene content is up to 20% by weight.

2. The composition of claim 1 wherein said elastomeric polymer and said olefin polymer are present in an amount of 0% by weight.

3. The composition of claim 2 wherein (a) said mixture of at least two copolymers of ethylene is present in an amount of from about 8 to about 30 percent by weight, (b) said filler is present in an amount of from about 50 to about 85 percent by weight, and (c) said plasticizer is present in an amount of from about 3 to about 10 percent by weight.

4. The composition of claim 3 wherein the ratio of copolymer (A) to copolymer (B) is from about 97/3 to about 60/40.

5. The composition of claim 4 wherein said filler is selected from the group consisting of calcium carbonate, barium sulfate, hydrated alumina clay, magnesium carbonate, calcium sulfate, silica flyash, cement dust, wood flour, ground rice hulls and mixtures thereof.

6. The composition of claim 5 wherein said filler is selected from the group consisting of calcium carbonate, barium sulfate, hydrated alumina, and mixtures thereof.

7. The composition of claim 6 wherein copolymer (A) has a polar comonomer content of from about 5 to about 23 percent by weight, an ethylene content of from about 72 to about 95 percent by weight and a melt index of from about 0.3 to about 10; and wherein copolymer (B) has a polar comonomer content of from about 30 to about 65 percent by weight, an ethylene content of from about 35 to about 70 percent by weight and a melt index of from about 10 to about 200, provided that the polar comonomer content of copolymer (B) is at least 15 percent by weight higher than the polar comonomer content of copolymer (A), and when the filler level is at least 70 percent by weight said composition exhibits a tensile elongation at least 100% higher than a blend containing a single copolymer of ethylene having the same polar comonomer content and melt index as the mixture of at least two copolymers of ethylene has.

8. The composition of claim 7 wherein said plasticizer is selected from the group consisting of processing oils.

9. The composition of claim 8 wherein said processing oil is selected from the group consisting of naphthenic and aromatic oils.

10. The composition of claim 9 wherein said plasticizer is a mixture of ($\alpha$) processing oil; and ($\beta$) polyester or polyether or polyether ester or any combination thereof; wherein said processing oil is present in an amount of from about 50 to about 95 percent by weight.

11. The composition of claim 10 wherein said processing oil is present in an amount of from about 50 to about 80 percent by weight.

12. The composition of claim 10 wherein said copolymers of ethylene are selected from the group consisting of ethylene/vinyl acetate, ethylene/acrylic acid and its ionomers, ethylene/methacrylic acid and its ionomers, ethylene/methyl acrylate, ethylene/ethyl acrylate, ethylene/isobutyl acrylate, ethylene/normal butyl acrylate, ethylene/isobutyl acrylate/methacrylic acid and its ionomers, ethylene/normal butyl acrylate/methacrylic acid and its ionomers, ethylene/isobutyl acrylate/acrylic acid and its ionomers, ethylene/normal butyl acrylate/acrylic acid and its ionomers, ethylene/methyl methacrylate, ethylene/vinyl acetate/methacrylic acid and its ionomers, ethylene/vinyl acetate/acrylic acid and its ionomers, ethylene/vinyl acetate/monoethyl maleate and ethylene/methyl acrylate/monoethyl maleate.

13. The composition of claim 12 wherein said copolymers of ethylene are selected from the group consisting of ethylene/vinyl acetate, ethylene/ethyl acrylate, ethylene/methyl acrylate, ethylene/isobutyl acrylate, and ethylene/methyl methacrylate.

14. The composition of claim 12 wherein (a) said mixture of at least two copolymers of ethylene is present in an amount of from about 11 to about 25 percent by weight, (b) when said filler is calcium carbonate or hydrated alumina the amount of filler is from about 65 to about 80 percent by weight, and when said filler is barium sulfate the amount of filler is from about 70 to about 85 percent by weight, and (c) said plasticizer is present in an amount of from about 4 to about 8 percent by weight.

15. The composition of claim 14 wherein copolymer (A) has a polar comonomer content of from about 10 to about 25 percent by weight, an ethylene content of from about 75 to about 90 percent by weight and a melt index of from about 0.5 to about 2 and wherein copolymer (B) has a polar comonomer content of from about 33 to about 60 percent by weight, an ethylene content of from about 40 to about 67 percent by weight and a melt index of from about 15 to about 100, and wherein the ratio of copolymer (A) to copolymer (B) is from about 95/5 to about 65/35, provided that the polar comonomer content of copolymer (B) is at least 18 percent by weight higher than the polar comonomer content of copolymer (A), and when the filler level is at least 70 percent by weight said composition exhibits a tensile elongation at least 150% higher than a blend containing a single copolymer of ethylene having the same polar comonomer content and melt index as the mixture of at least two copolymers of ethylene has.

16. The composition of claim 15 wherein the ratio of copolymer (A) to copolymer (B) is from about 85/15 to about 65/35.

17. The composition of claim 15 wherein said copolymers of ethylene are ethylene/vinyl acetate copolymers.

18. The composition of claim 7 wherein said plasticizer is selected from the group consisting of polyesters.

19. The composition of claim 18 wherein said polyester is a liquid condensation product of ($\alpha$) a dibasic acid selected from the group consisting of saturated aliphatic dibasic acids and aromatic dibasic acids and ($\beta$) a polyol selected from the group consisting of aliphatic polyols and polyoxyalkylenepolyols.

20. The composition of claim 19 wherein greater than 50 percent by weight of the acid component of said polyester is selected from dibasic acids and the polyol component is selected from aliphatic glycols.

21. The composition of claim 7 wherein said polyether is selected from polyols based on random and block copolymers of ethylene oxides or propylene oxides.

22. The composition of claim 7 wherein said polyether ester is selected from esters of polyols based on polymers or copolymers of ethylene oxides or propylene oxides.

23. The composition of claims 1, 3, 7, 14, 17, 21 or 22 in the form of a sound-deadening sheet.

24. A carpet having a backside coating consisting essentially of the composition of claims 1, 3, 7, 14, 17, 21 or 22.

25. An automotive carpet having a backside coating consisting essentially of the composition of claims 1, 5, 7, 14, 17 21 or 22.

26. The composition of claims 4, 8, 13, 17, 19, 21 or 22 containing at least one modifier selected from the following groups (d) from 0 to about 27% by weight of unvulcanized elastomeric polymer; and (e) from 0 to about 48% by weight of olefin polymer selected from the group consisting of low density branched polyethylene, high density linear polyethylene, linear copolymers of ethylene and another olefin comonomer, polypropylene and copolymers of propylene and ethylene where the ethylene content is up to 10% by weight.

27. The composition of claims 4, 8, 13, 17, 19, 21 or 22 containing at least one modifier selected from the following groups (d) unvulcanized elastomeric polymer selected from the group consisting of styrene-butadiene rubber, polyisobutylene, ethylene/propylene rubber, and terpolymers of ethylene, propylene and a diene monomer; and (e) olefin polymer selected from the group consisting of high density linear polyethylene, linear copolymers of ethylene and another olefin comonomer and copolymers of propylene and ethylene where the ethylene content is up to 20% by weight provided that when present at all component (d) is present in an amount of from about 1 to about 17% by weight and component (e) is present in an amount of from about 1 to about 22% by weight.

28. The composition of claims 4, 8, 13, 17, 19, 21 or 22, containing at least one modifier selected from the following groups (d) unvulcanized elastomeric polymer selected from the group consisting of ethylene/propylene and terpolymers of ethylene, propylene and a diene monomer, wherein the ethylene content is from above 20 to about 80% by weight and the diene content is from 0 to about 5% by weight, said dienes being selected from the group consisting of methylene norbornene, ethylidene norbornene, dicyclopentadiene and 1,4-hexadiene; and (e) olefin polymer selected from the group consisting of high density linear polyethylene, linear copolymers of ethylene and another olefin comonomer and copolymers of propylene and ethylene where the ethylene content is up to 20% by weight provided that when present at all component (d) is present in an amount of from about 2% to about 12% by weight and component (e) is present in an amount of from about 2 to about 15% by weight.

* * * * *